United States Patent [19]

McDonald

[11] 4,096,687

[45] Jun. 27, 1978

[54] METHOD FOR PRODUCING SLUBBED YARNS

[75] Inventor: Alan T. McDonald, Cranberry, Pa.

[73] Assignee: PPG Industries, Inc., Pittsburgh, Pa.

[21] Appl. No.: 793,673

[22] Filed: May 4, 1977

[51] Int. Cl.[2] ..... D02G 1/16; D02G 1/20

[52] U.S. Cl. ..... 57/157 F; 57/34 AT; 57/77.3; 28/271

[58] Field of Search ..... 57/34 R, 34 B, 77.3, 57/157 F, , 157 R, 164; 28/219, 252, 271, 274

[56] References Cited

U.S. PATENT DOCUMENTS

| | | | |
|---|---|---|---|
| 2,990,671 | 7/1961 | Bunting et al. | 57/34 B |
| 3,009,309 | 11/1961 | Breen et al. | 57/34 |
| 3,055,039 | 10/1977 | Movshovich et al. | 28/271 X |
| 3,079,745 | 3/1963 | Breen et al. | 57/34 |
| 3,110,151 | 11/1963 | Bunting et al. | 57/34 B |
| 3,443,292 | 5/1969 | Davis | 57/157 F X |
| 3,451,207 | 6/1969 | Sharp | 57/34 B |
| 3,727,275 | 4/1973 | Ohayon | 28/271 |
| 3,727,392 | 4/1973 | Gibbon | 57/157 F X |
| 3,730,137 | 5/1973 | Luscher et al. | 28/271 X |
| 3,982,412 | 9/1976 | Isoard et al. | 57/34 B X |
| 4,003,111 | 1/1977 | Drummond | 57/157 F X |
| 4,020,623 | 5/1977 | Drummond | 57/157 F |

*Primary Examiner*—Donald Watkins
*Attorney, Agent, or Firm*—Alan T. McDonald

[57] ABSTRACT

A method and apparatus are disclosed for producing randomly slubbed textile yarns. The method involves passing the yarn through a zone of fluid turbulence having a pair of counterdirectional fluid streams maintained under different fluid pressures. The yarn passing between these counterdirectional fluid streams is alternately treated in opposing directions, with slubs being formed at the null points between the opposite directional treatments. Due to the uneven fluid pressures employed, the length of treatment in each direction along the yarn is not consistent, thus leading to slubs at various points along the length of the yarn. A fluid jet is also disclosed for accomplishing this result. The fluid jet includes a pair of interconnected and overlapping passageways which form a chamber through which the yarn passes, with each passageway having one or more fluid inlets arranged to direct fluid circumferentially around it and with the fluid streams being counterdirectional to one another. The fluid inlets for each passageway are fed fluid at uneven or different fluid pressures to accomplish the random slubbing effect.

4 Claims, 5 Drawing Figures

METHOD FOR PRODUCING SLUBBED YARNS

BACKGROUND OF THE INVENTION

Decorative fabrics are readily produced from such fibrous yarns as nylon, polyester, acetate, glass, cotton, wool and the like. It is often desired by the textile manufacturers to weave fabric from yarns having various textured characteristics. One of the important textured yarns is a slub yarn. A slub yarn is a yarn which is not texturized or slightly texturized along the bulk of its length and includes a plurality of highly texturized bulbs or slubs formed at locations along the length of the yarn. Numerous processes are known for the production of slub yarn. Various processes of this type are those found in U.S. application Ser. No. 749,198, which is incorporated herein by reference. In this application, it is theorized that slubs are produced by a "double-vortex" effect. In this theory, the yarn is passed between a pair of counterdirectional fluid streams which alternately twist the yarn in opposite directions. At the null points, i.e., the reversals in the direction of the twists, a puff or slub is formed in the yarn.

An improved fluid jet for producing this "double-vortex" effect is shown in U.S. application Ser. No. 793,590 of Warren W. Drummond, filed concurrently with the present application and incorporated herein by reference. In this application, the yarn passes through a fluid chamber which is generally figure-eight shaped and formed by a pair of interconnected and overlapping passageways, with each passageway of the chamber having one or more fluid inlets along its length designed to direct treating fluid circumferentially around that passageway, such that a pair of counterdirectional fluid streams are provided in the fluid treatment chamber.

In both aforementioned application Ser. Nos. 749,198 and 793,590, slubs of high quality are formed. However, due to the nature of the "double-vertex", the yarn tends to follow the generally figure-eight pattern of the counterdirectional fluid streams quite consistently, with the result that the slubs in the yarn are produced at quite regular intervals.

For the makers of textile fabrics, problems can arise when the slubs in a textile yarn used to produce fabrics occur too regularly. First, the fabric tends to develop a pattern rather than a random texturized effect. This is undesirable, since the pattern must then be matched in another fabric when the fabric is to be used for decorative purposes, such as draperies and the like. Second, streaks can be seen in the fabric as areas of low density between regular slubs of high density. This makes the fabric unacceptable.

In U.S. Pat. No. 3,835,511 an apparatus is disclosed for randomizing the formation of slubs in a textile yarn. The apparatus includes a rotating wheel with actuating regions thereon and a sensing means, with slubs being formed at each point where the sensing means "reads" an actuating point on the rotating wheel much like a phonograph stylus "reads" a record. While this device does produce yarns having random slubs, it is desirable to produce slubs in textile yarns without the need for intricate apparatus.

THE PRESENT INVENTION

By means of the present invention, random slub formation can be accomplished without the necessity of any programmable or other actuating means. The present invention involves a method and apparatus for producing randomly slubbed yarn. The method involves passing the yarn through a zone of fluid turbulence. This zone comprises a pair of interconnected and overlapped passageways constructed and arranged to produce a pair of counterdirectional streams of treating fluid therein, with the pressures on the fluid streams being unequal. The yarn passing from stream to stream is twisted in opposing directions by the steams. At the null points, i.e., the points of exit of the yarn from one stream and entry into the other, where the direction of twist on the yarn is reversed, a texturized puff or slub is formed. Due to the unequal gaseous fluid pressures within the zone, the yarn does not regularly switch from stream to stream, but does so at random intervals. This randomizes the production of slubs along the yarn.

Apparatus for accomplishing this result comprises a fluid jet having a central chamber along its length through which the yarn passes. The chamber is formed by a pair of interconnected and overlapped passageways. The chamber generally resembles a figure-eight in shape. Each passageway of the chamber includes one or more fluid inlets constructed and arranged to direct treating fluid circumferentially around the passageways counterdirectionally to one another. The fluid inlets of each passageway are connected to separate fluid supplies, which supply fluid, and preferably gaseous fluid, to the inlets for each passageway at uneven pressures. Due to the uneven pressures within the passageways, the yarn will not follow the contour of the chamber regularly, but will tend to remain in the passageway under lower fluid pressure a higher percentage of the time. At each passage of the yarn from one passageway to the other, a slub is formed in the yarn. Due to the fact that the yarn does not spend equal amounts of time in each passageway, the slubs are randomly spaced from one another. The rate of slub formation can be varied by varying the relative fluid pressures between the passageways in the chamber, the speed of travel of the yarn through the jet and the tension on the yarn.

BRIEF DESCRIPTION OF THE DRAWINGS

The present invention will be more fully described with reference to the drawings in which.

DETAILED DESCRIPTION OF THE DRAWINGS

Figure 4:
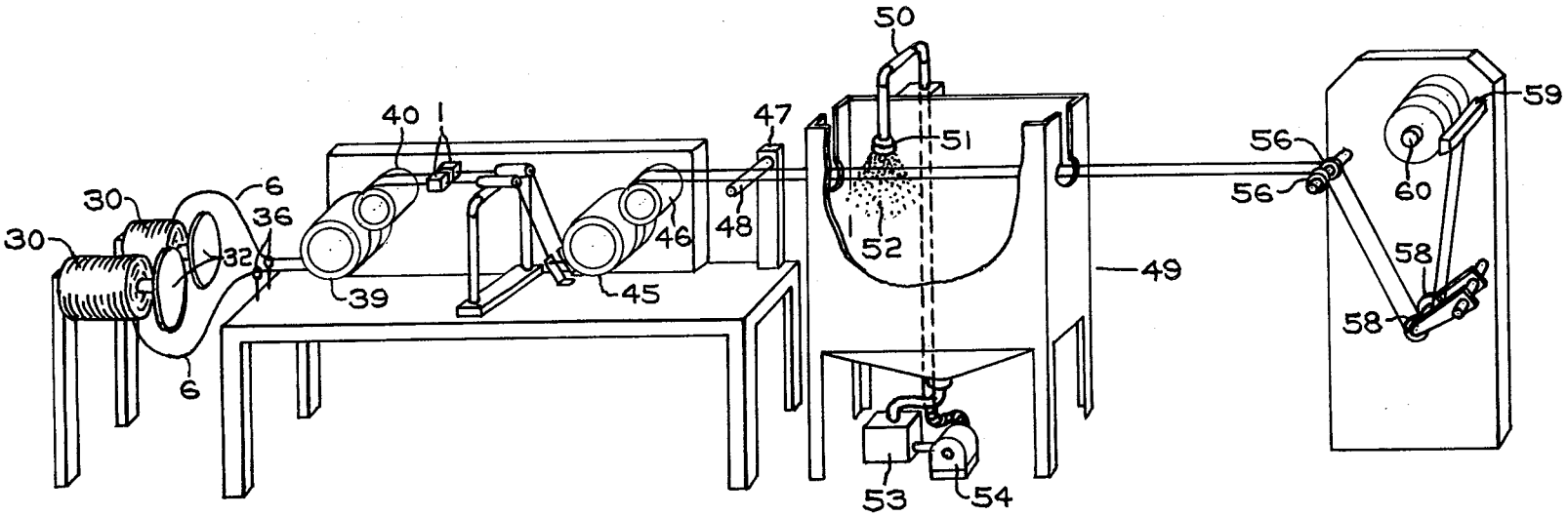
FIG. 4 is a diagrammatic representation of a slub yarn forming operation employing the method and apparatus of the present invention.

Turning now to the figures, and in particular FIGS. 1 through 3 and 5, a fluid jet 1 is shown having a main body 2 and a pair of interconnected and overlapping passageways 3 and 4. The passageways 3 and 4 form a chamber 10 which has a generally figure-eight shape. While the chambers 3 and 4 are illustrated as being round, the passageways 3 and 4 could take any desired shape, such as elliptical, oval, triangular and the like, with the result that the chamber 10 has a shape which resembles generally a figure-eight.

Figure 2:
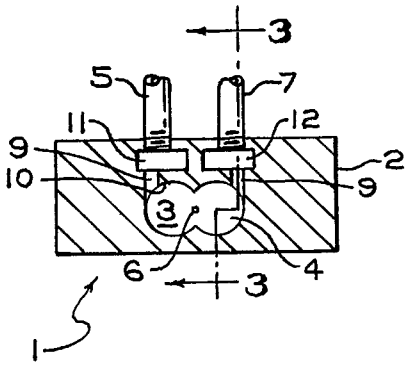
FIG. 2 is a cross-sectional view of the jet taken through line 2—2 of FIG. 1.
Figure 3:
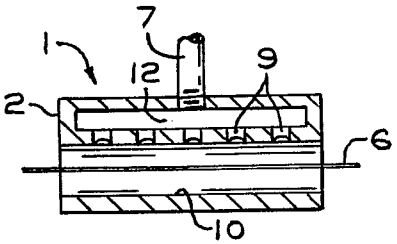
FIG. 3 is a cross-sectional view of the jet taken through line 3—3 of FIG. 2.

As can best be seen in FIGS. 2 and 3, each of the passageways 3 and 4 are connected in fluid transfer relation with one or more fluid inlets 9 along their lengths. The fluid inlets 9 connected to chamber 3 receive treatment fluid, and preferably gaseous fluid, such as air, oxygen, nitrogen and the like, through fluid intake 5, which is preferably connected to fluid chamber 11, which is in turn connected to the fluid inlets 9. Optionally, each fluid inlet 9 could be connected directly to the fluid intakes. Likewise, the fluid inlets 9 connected to passageway 4 receive fluid from intake 7 which is preferably connected in fluid transfer relation to fluid chamber 12 and the inlets 9.

The jet 1 may be formed of numerous materials, including plastic, ceramic, glass and metal. Preferably, the jet 1 is constructed of a metal, such as brass or stainless steel.

The jet 1 may be formed as a single piece, with the chamber 10 being formed by a pair of overlapped drillings into the walls of the jet 1. The fluid inlets 9 and common fluid chambers or headers 11 and 12 are then drilled into the body 2, with plugs employed to seal the inlets 9 and fluid chambers 11 and 12 at their ends.

The jet 1 may also be formed of two or more sections. Thus, for example, two sections may be machined to be connected at the overlap and interconnection of the passageways 3 and 4 or at the connection of the fluid inlets 9 to the passageways 3 and 4, or a combination of these may also be employed.

As previously mentioned, the chamber 10 is formed by the intersecting, overlapping passageways 3 and 4. The chamber 10 is thus formed within the walls of the body 2. At the intersection and overlap of the passageways 3 and 4, there is a constriction in the chamber 10. Thus, the height of the chamber 10 at the intersection of the passageways 3 and 4 is less than the height at the center of the passageways 3 and 4. Also, the cross-sectional area of the intersection is smaller than the balance of either passageway 3 or 4.

Again looking at the chamber 10, the chamber may be formed of four arcs, two of which are approximately colinear and the other two arcs being mirror images of the first two. The central portions of the approximately colinear arcs intersect and overlap one another to form the constriction previously described.

Figure 5:
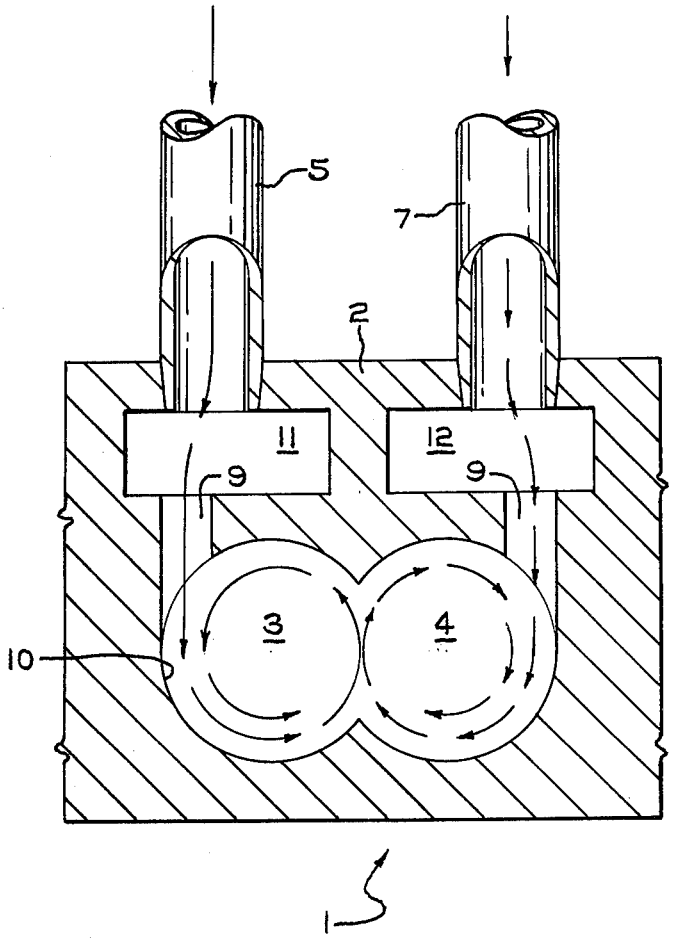
FIG. 5 is an expanded view of the chamber and fluid inlets, illustrating the fluid flow through the jet.

As can best be seen in FIG. 5, the fluid inlets 9 are constructed and arranged to direct the treating fluid circumferentially around the passageways 3 and 4 respectively. Thus, the treating fluid within passageway 3 flows in a counterclockwise direction, while the treating fluid in passageway 4 flows in a clockwise direction. Yarn 6 passes through the chamber 10 and is alternately treated by the fluid within passageways 3 and 4. In each passageway, the treating fluid entangles the filaments of the yarn with one another and imputes a false twist to the yarn in the direction of the fluid flow. At the null points, i.e., the points where the yarn 6 passes from passageway 3 to passageway 4 and the direction of twist reverses, puffs or slubs are formed in the yarn 6.

To randomize the slubs in the yarn, the treatment fluid from intakes 5 and 7 are fed to the jet 1 under unequal pressures. Thus, the intake pressure for each of the intakes 5 and 7 may range from about 5 to 80 psig (0.35 to 5.6 kilograms per square centimeter gauge), but the pressures are not equal. Due to the pressure differential within the passageways 3 and 4, the yarn 6 passing between the passageways 3 and 4 does not spend equal amounts of time in the passageways 3 and 4, but rather remains for a longer portion of time in the passageway under the lower pressure. Because of this, the slubs in the yarn 6 are not formed at regular intervals, as they would be if the yarns 6 followed the generally figure-eight shape of the chamber 10 regularly, but rather are formed at irregular intervals.

Control of the randomness of the slubbing and degree of slubbing can be accomplished by varying the pressure differential and absolute pressures of the fluid intakes 5 and 7, the speed of the yarn 6 passing through the jet 1, and the tension on the yarn 6.

Figure 1:
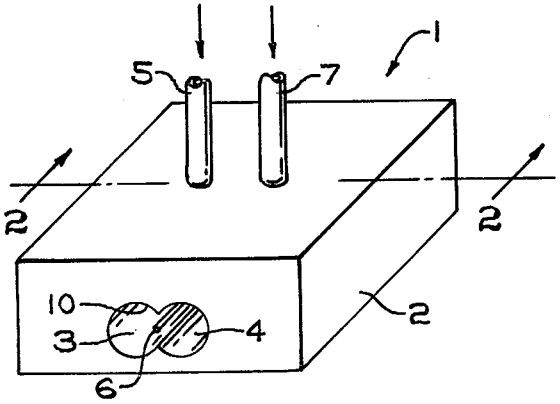
FIG. 1 is a perspective view of the fluid jet of the present invention.

FIG. 4 illustrates an apparatus which may be employed to produce a slubbed yarn in accordance with the present invention. The yarns 6 are removed from forming packages 30. The yarns 6 pass over the exterior of wheels 32 so that the yarns 6 can be removed from the outside of the packages without any snagging. The yarns 6 pass through yarn guides 36 and over the surface of a drive roll 39 coupled for rotation to a suitable drive source (not shown) and subsequently over a nip roller 40 journaled for rotation with its outer cylindrical surface in frictional contact with the outer cylindrical surface of roll 39. Yarns 6 are then passed from the surface of the nip roll 40 and through the fluid jets 1 as shown in FIGS. 1, 2 and 3.

After emerging from the fluid jets 1, yarns 6 pass through strand guides 37 and over drive roll 45 which is coupled to a power source (not shown) for rotation. The yarns 6 pass from roll 45 over the surface of a nip roll 46 which is journaled for rotation with its outer cylindrical surface in frictional contact with the outer cylindrical surface of roll 45. Yarns 6 are then passed over guide bar 48 mounted on a bracket 47 and the yarns 6 are passed under a binder spray head 51 which applies binder 52 to the yarns. Binder 52 is pumped to the spray head 51 by a pump 54 through pipe 50 from a binder reservoir 53. Excess binder is collected continuously in reservoir 53 by a suitable drain arrangement in the bottom of the binder applicator zone.

The binder used can be any desired composition consistency and viscosity so long as it can be applied through the spray head 51. Thus, binders containing starches, oils, resin, hot metals or solvent type materials and the like including emulsions, suspensions, dilutions and the like can be utilized. It is not a requirement of the present invention that this binder be applied to the yarns 6. However, it has been found that such after-treatment of the yarns 6 helps set the slubs in the yarns 6 and can provide other beneficial effects to the yarns 6.

Yarns 6 are passed to the winding operation after binder 52 is applied thereto by passing them over rolls 56. The yarns 6 are then passed over tension rolls 58 which coact with a motor (not shown) driving mandrel 60 to maintain constant tension on the yarns 6 during winding and maintain constant take-up winding speed of the yarns 6. The yarns 6 are wound in two packages on winder 60 which is equipped with a roller bail 59 to maintain the packages smooth on the surface and square ended. The texturizing of and binder application to the yarn 6 is more fully described in U.S. Pat. No. 3,730,137, which is incorporated herein by reference, and the winder 60 employed with the tension rolls 58 is the winder more fully described in U.S. Pat. No. 3,814,339, which is incorporated herein by reference.

As previously mentioned, the degree of slubbiness in the yarn is controlled by the speed of passage of the yarn through the fluid jet 1, the fluid pressures in the jet 1 and the tension on the yarn 6. Fluid pressure differentials are controlled by controlling the fluid input through intake lines 5 and 7. As illustrated in FIG. 4, speed of passage of the yarns 6 through the jet 1 is controlled by controlling the speed of the mandrel 60. The tension on the yarns 6 as they pass through the jets 1 is controlled by the relative speed of drive rolls 39 and 45. In operation, drive roll 39 is operated at a speed somewhat in excess of the speed of drive roll 45. Thus, the speed of the yarns 6 entering the fluid jets 1 is slightly in excess of the speed of exit from the jets 1. This speed differential between drive rolls 39 and 45 is expressed as percent overfeed. This percentage of overfeed generally ranges from 1 to 10 percent or higher. At higher overfeed percentages, the tension in the yarns 6 as they pass through the jets 1 is essentially zero. This will produce larger and more frequent slubs in the yarn 6. For different novelty effects, the percentage of overfeed can be adjusted to produce slubs which occur somewhat less often and which are somewhat smaller.

From the foregoing, it is obvious that the present invention provides a method and apparatus for producing randomly slubbed textile yarns of varying characteristics for use by textile manufacturers.

While the invention has been described with reference to certain specific embodiments thereof, it is not intended to be so limited thereby, except as set forth in the accompanying claims.

I claim:

1. A method for forming a randomly slubbed yarn comprising passing a textile yarn through a fluid jet having a pair of passageways along its length, said passageways being interconnected and overlapped along their lengths and having at least one fluid inlet in fluid flow communication therewith, introducing the strand into one of said passageways while directing a fluid circumferentially around said passageway at a first pressure to thereby treat said yarn with said fluid while moving the strand around the wall of said passageway, passing said yarn to said second passageway while directing a fluid circumferentially around said second passageway at a second pressure in the opposing direction to said directing of said fluid in said first passageway to thereby treat said yarn with said fluid in said second passageway while moving the strand around the wall of said second passageway and alternating said yarn between said passageways in a random pattern during its passage through the jet to thereby produce a randomly slubbed yarn.

2. The method of claim 1 wherein said fluid pressures are between about 5 and 80 psig (0.35 and 5.6 kilograms per square centimeter gauge).

3. The method of claim 1 further comprising winding said yarn.

4. The method of claim 3 further comprising applying a binder to said yarn.

* * * * *